US006300749B1

(12) United States Patent
Castelli et al.

(10) Patent No.: US 6,300,749 B1
(45) Date of Patent: Oct. 9, 2001

(54) LINEAR VOLTAGE REGULATOR WITH ZERO MOBILE COMPENSATION

(75) Inventors: Claudia Castelli, Brugherio; Francesco Villa, Gorgonzola, both of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/563,100

(22) Filed: May 2, 2000

(51) Int. Cl.[7] ..... G05F 1/40; G05F 5/00

(52) U.S. Cl. ..... 323/273; 323/303; 323/276; 323/281

(58) Field of Search ..... 323/303, 270, 323/273, 274, 276, 280, 281

(56) References Cited

U.S. PATENT DOCUMENTS

| | | | | |
|---|---|---|---|---|
| 4,908,566 | * | 3/1990 | Tesch | 323/280 |
| 5,105,102 | * | 4/1992 | Shioda | 326/73 |
| 5,631,598 | * | 5/1997 | Miranda et al. | 327/540 |
| 5,686,821 | * | 11/1997 | Brokaw | 323/273 |
| 5,861,736 | * | 1/1999 | Corsi et al. | 323/273 |
| 5,939,867 | * | 8/1999 | Capici et al. | 323/277 |
| 6,040,736 | * | 3/2000 | Milanesi et al. | 327/541 |

FOREIGN PATENT DOCUMENTS 0 810 504-A1 * 12/1997 (EP) ..... G05F/1/100

0 864 956-A2 * 9/1998 (EP) ..... G05F/3/24

* cited by examiner

*Primary Examiner*—Peter S. Wong
*Assistant Examiner*—Bao Q. Vu
(74) *Attorney, Agent, or Firm*—Theodore E. Galanthay; Robert Iannucci; Seed IP Law Group, PLLC

(57) ABSTRACT

A method and apparatus to dynamically modify the internal compensation of a low drop out linear voltage regulator is presented. The process involves using zero mobile compensation; when the output pole of the voltage regulator moves, a compensating zero is moved toward higher frequencies. This compensation zero is used to compensate the effect of a second pole in the loop gain. The circuit includes an input stage having an error amplifier. The error amplifier includes a differential stage output coupled to an output terminal of the buffer stage. An output stage of the circuit includes an output transistor having a conduction terminal connected to an output terminal of the voltage regulator, and having a control terminal coupled to the output terminal of the buffer stage. Additionally, a variable compensation network is connected between the differential stage output and a voltage reference. This variable compensation network can include an RC circuit having a resistive transistor. The resistance value of the resistive transistor is modulated according to the output load current of the voltage regulator, thereby changing the location of the compensating zero.

8 Claims, 5 Drawing Sheets

LINEAR VOLTAGE REGULATOR WITH ZERO MOBILE COMPENSATION

TECHNICAL FIELD

The present invention relates in general to a voltage regulator circuit and, more specifically, to a linear voltage regulator having a low drop out.

BACKGROUND OF THE INVENTION

Voltage regulators having a low drop out (LDO) are used in power management control systems for portable devices such as notebooks, cellular phones and similar devices supplied by a battery.

A good power management control system best utilizes the energy stored in the battery in order to increase the autonomy of the portable device by allowing the use of smaller batteries, thereby reducing the weight and size of the portable devices.

To this aim the voltage regulation at the control system output should have high static and dynamic characteristics and a high current efficiency at any load condition.

The structure of a known LDO linear voltage regulator is disclosed in the book "Analog Devices" in the chapter "Low-Drop_out Regulators" by W. Joung and is shown in FIG. 1. Such a regulator includes an error amplifier Ae having an output connected to a gate terminal of power PMOS pass transistor.

A reference voltage Vref is supplied to a first input of the error amplifier Ae, while the other input of the same amplifier receives a feedback signal from a voltage divider connected to a conduction terminal of the PMOS transistor.

An input voltage Vin is applied to the other conduction terminal of the PMOS transistor.

A circuit node connecting the PMOS transistor and the voltage divider is the output terminal OUT of the LDO voltage regulator. An output capacitance Co is connected between the output terminal OUT and a ground reference GND. A parasitic resistance ESR is serially connected to this output capacitance.

An optional by-pass capacitance Cb is connected in parallel to the series RC connection including the output capacitance Co and the parasitic resistance ESR.

This circuit structure has an output dominant pole Pout determined by the output capacitance Co according to the following relation:

$$Pout=1/(2\Pi*Rout*Co)\cong(\lambda Iload+Ipart)/(2*Co)$$

Where: $\lambda$ is the channel length modulation (i.e., the inversion of the Early voltage (the voltage at which saturation lines for different Vgs voltages converge on the Vds axis)), Iload is the load current, and Ipart is the biasing current of the voltage divider.

This pole is movable according to load variations and reaches its maximum value when the regulator supplies the maximum output current.

For instance, the output pole may vary along four decades if the load current passes from 0 to 100 mA when the biasing current Ipart is about 10 $\mu$A.

In general, the dependence from the load current of the output pole renders the compensation of this type of regulator pretty complex; see in this respect the article by C. Simpson: "LDO require proper compensation"; Electronic Design, November 1996.

A second pole Pin of the above disclosed regulator is due to the error amplifier Ae.

Without a proper compensation, the two poles Pout and Pin would render the regulator unstable.

For this reason, a circuit component is always provided to introduce a zero, thereby compensating the effects of the output pole Pout. This circuit component is the parasitic resistance ESR that generates a zero at the following frequency:

$$Zesr=1/(2\Pi*ESR*Co)$$

This compensation is critical because in order to guarantee the regulator stability, the resistance value ESR must be kept within a predetermined range of values.

As a matter of fact, if ESR is reduced, the zero frequency Zesr is increased and is moved toward the right side of the pole-zero diagram thereby reducing the compensation effect on the output pole.

On the contrary, if the ESR value is increased, the zero frequency Zesr is reduced and is moved toward the left side of the pole-zero diagram with the risk of introducing further poles and rendering the system unstable.

Unfortunately, the series resistance ESR is a parasitic component of the output capacitance and its value may not be determined with high precision.

For this reason the known LDO regulators are provided with a diagram reporting the range of those ESR resistance values that guarantee stability for the voltage regulator.

Care must be taken in choosing the output capacitance Co. For instance an Aluminium electrolytic capacitor should not be used since its ESR value varies with temperature. Other kind of capacitors, such as ceramic capacitors or OS-CON capacitors cannot be used because of their low ESR value.

Tantalum capacitors may be suitable since their ESR resistance value is stable with temperature and close to the central value of the stability range.

The presence of the series resistance ESR depresses the loading transient of the voltage regulator. The voltage output drop is directly proportional to the value of the resistance ESR serially connected to the output capacitance Co.

The by-pass capacitance Cb may be added to reduce the effect of the resistance ESR, but such a further capacitance increases the costs and the circuit area and brings also a further pole at a frequency:

$$Pb\cong1/(2\Pi*ESR*Cb)$$

There has yet to be produced an LDO linear voltage regulator which overcomes the inherent limitations of output compensation problems.

SUMMARY OF THE INVENTION

Embodiments of the present invention overcome these limitations by improving the response characteristics of an LDO voltage regulator by varying the compensation.

These embodiments perform this variable compensation without using a compensation resistance ESR to stabilize the amplifier loop of the voltage regulator, as in the prior art.

Still further embodiments of this invention provide an LDO voltage regulator including ceramic capacitors that have a smaller size, smaller charge time and a better reliability if compared with Tantalum capacitors used in the known regulators.

These advantages are reached by using an adaptive compensation technique that we will hereinafter call Zero Mobile Compensation (ZMC), since it provides in the circuit response a zero capable of moving according to the load variations.

More specifically the inventive LDO linear voltage regulator includes a zero that is moved toward higher frequencies according to the movements of the output pole Pout.

DETAILED DESCRIPTION

Figure 1:
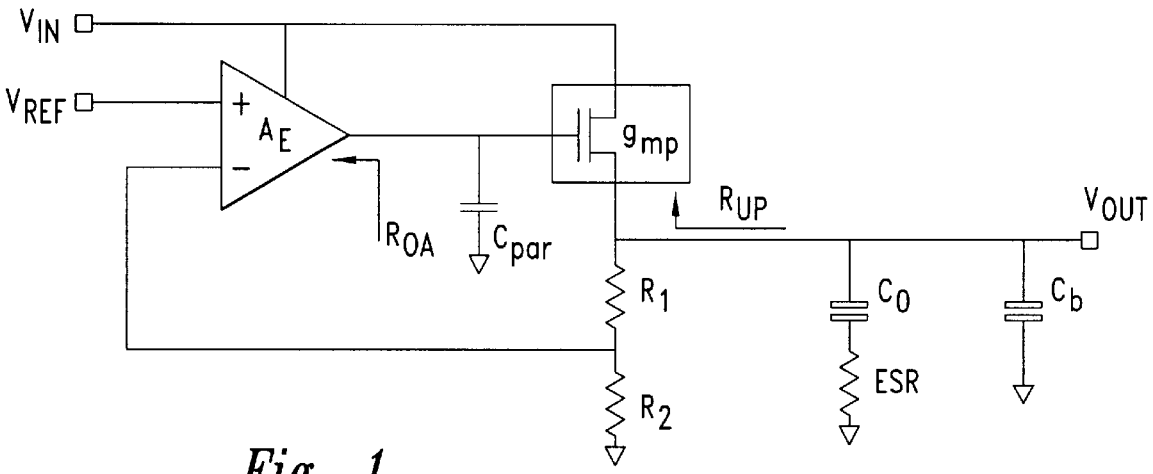
Fig. 1 (Prior Art)
FIG. 1 is a schematic diagram showing the structure of a known LDO linear voltage regulator.
Figure 2:
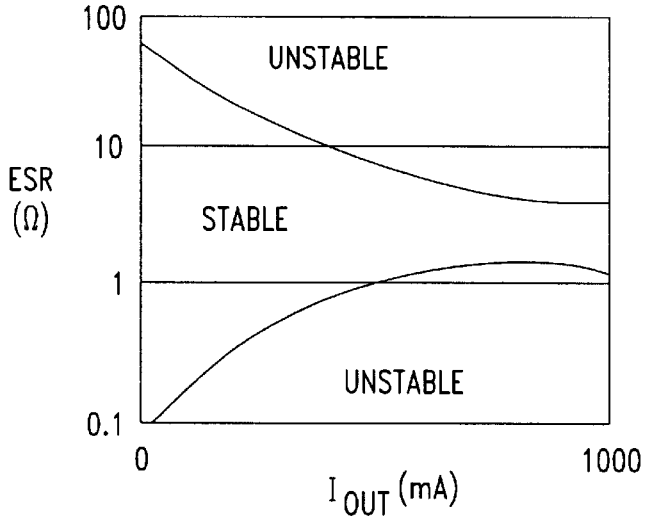
Fig. 2 (Prior Art)
FIG. 2 is a graph reporting the range of those ESR resistance values that guarantee stability for the voltage regulator of FIG. 1.
Figure 3:
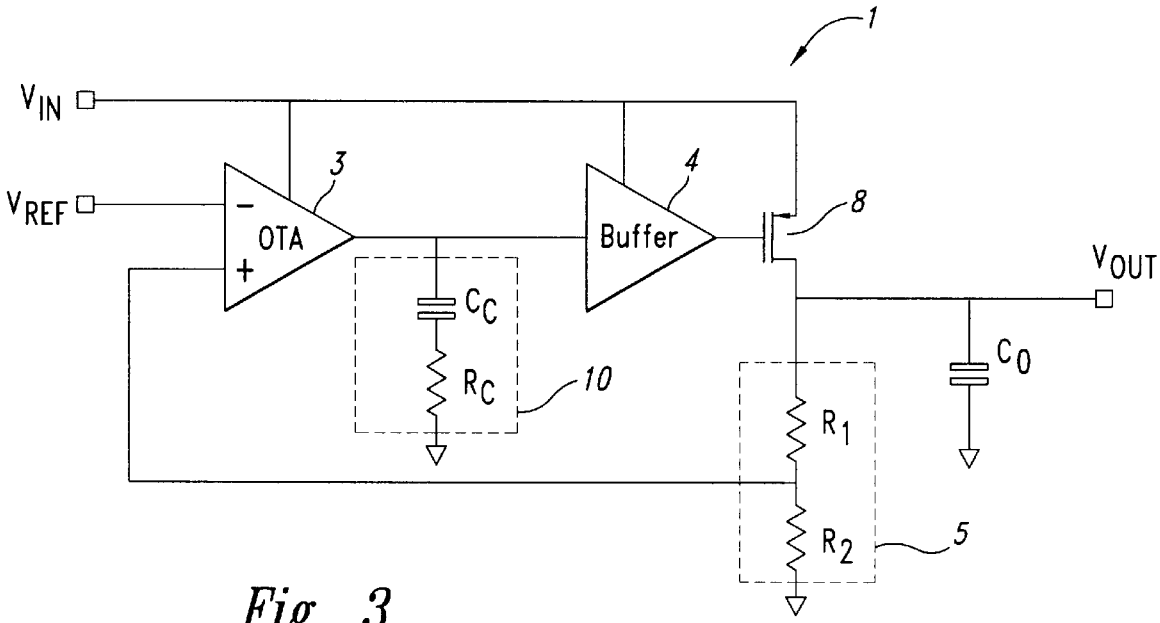
FIG. 3 is a schematic diagram showing the structure of a LDO linear voltage regulator according to an embodiment of the invention.

With reference to the drawings figures, and more specifically to FIG. 3, with 1 is schematically shown an LDO voltage regulator according to an embodiment of the present invention.

The regulator 1 includes an error amplifier that comprises a differential gain stage 3 connected to a buffer stage 4. More specifically, the differential stage 3 is an operational transconductance amplifier OTA and a reference voltage Vref is applied to an inverting input of this differential stage 3.

The buffer stage 4 has a unitary gain and an output of the buffer stage 4 is connected to a gate terminal of a PMOS pass-transistor 8.

An input voltage Vin is supplied to the gain stage 3, to the buffer stage 4 and to a conduction terminal of the PMOS transistor 8.

The other conduction terminal of the PMOS transistor 8 is an output terminal OUT of the LDO voltage regulator 1. This terminal OUT is connected to a ground reference GND through a voltage divider 5 including at least a first R1 and a second resistance R2.

The circuit node connecting these two resistances R1, R2 of the voltage divider 5 is feedback connected to a non-inverting input of the operational amplifier 3.

An output capacitance Co is connected between the output terminal OUT and the ground reference GND.

According to this embodiment, the buffer stage 4 isolates a large parasitic capacitance Cgate of the gate terminal of the PMOS transistor 8, and a large output resistance of the gain stage 3.

In this manner, the capacitance Cgate defines a parasitic pole at a frequency that depends from the impedance value at the output of the buffer stage 4 and given by:

$$P_{Gpar}=1/(2\Pi*Cgate*R_{OutBuff})$$

If the resistance value at the buffer output is sufficiently low, this pole is moved toward a frequency range closer to that of the other parasitic poles of the circuit.

The buffer stage 4 uncouples the gain stage 3 from the PMOS transistor 8 so that a compensation of the entire LDO voltage regulator may be implemented by a delay phase network introducing a zero and a pole at the lower frequency.

This delay phase network may be formed by an RC network circuit 10 portion including a resistance Rc serially coupled to a capacitance Cc. The RC network 10 is connected between an output node of the gain stage 3 and ground, as clearly shown in FIG. 3.

In a preferred embodiment, the resistance Rc may be formed by a MOS transistor, for instance.

The compensation pole and zero so obtained by the RC network 10 are located at the following frequency values:

$$fp=1/(2\Pi*Cc*ROTA)$$

$$fz=1/(2\Pi*Cc*Rc)$$

The compensation zero is used to compensate the effect of a second pole in the loop gain.

Figure 4:
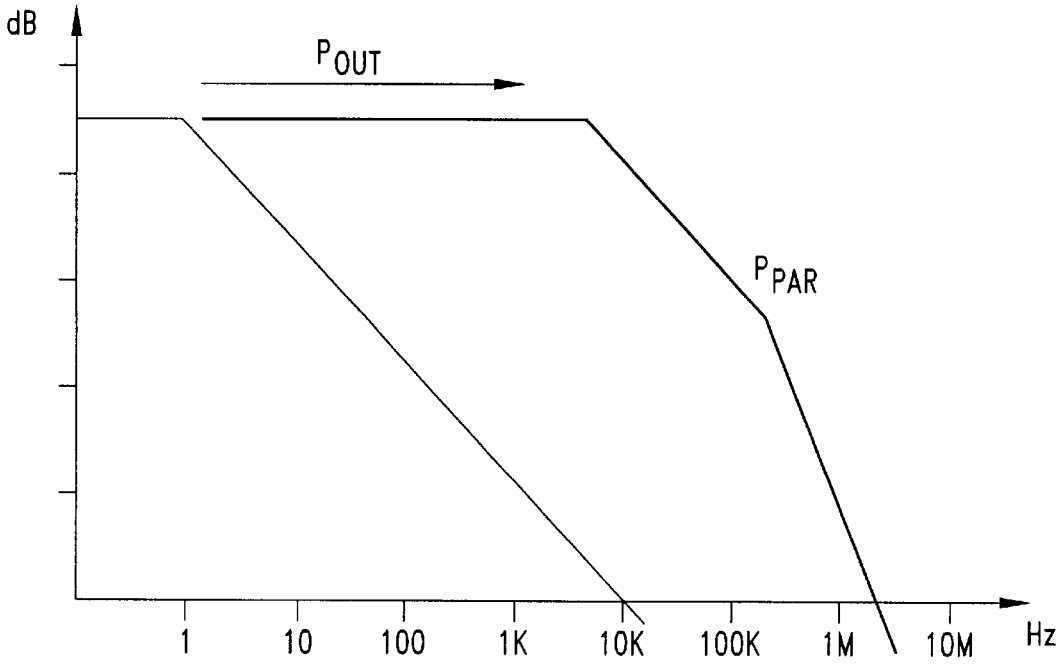
FIG. 4 is a Bode diagram showing the loop gain without compensation for a null load working condition, and for a maximum load working condition of a LDO linear voltage regulator.

In this respect, FIG. 4 shows a Bode diagram of the loop gain without compensation for a null load working condition and for a maximum load working condition respectively. From this diagram it may be appreciated that an efficient compensation of the circuit could be obtained by a zero set at a frequency proportional to the load current.

Figure 5:
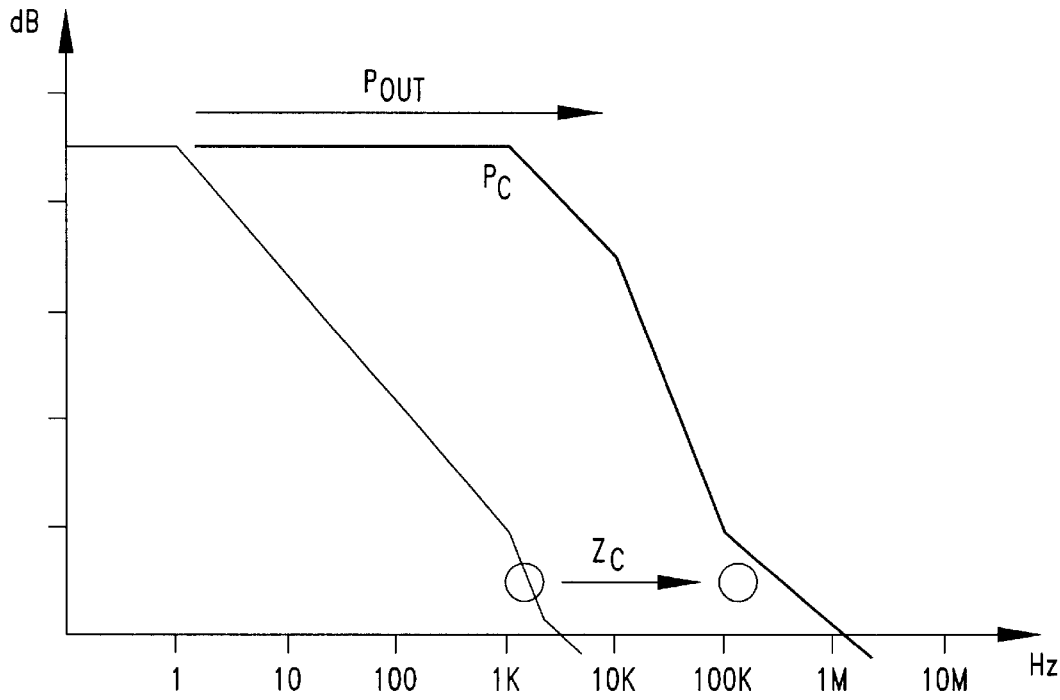
FIG. 5 is a Bode diagram showing the loop gain after Zero Mobile Compensation for a null load working condition, and for a maximum load working condition of a LDO linear voltage regulator.

A bode diagram showing the output of the LDO voltage regulator in accordance with an embodiment of this invention is shown in FIG. 5. Similar to the diagram of FIG. 4, this diagram shows the loop gain for a null load working condition and for a maximum load working condition respectively. However, this figure shows the effects of the compensation circuit. It is easily appreciated that the circuit is compensated by a zero that moves to higher frequencies proportional to the load current.

Since passive resistors cannot be electrically modified to provide a variable zero, a resistance value obtained by a MOS transistor (in a triode zone) may be changed by varying the overdrive voltage applied to the transistor gate. The resistance value of a MOS transistor may be defined by:

$$R=1/[Cox(W/L)(Vgs-Vt)]$$

An increment of the overdrive voltage and of the load current reduces the value of the resistance Rc of the compensation network RC and the compensation zero is moved toward higher frequencies.

This sensing of the load current can be performed by a circuit easily integrated into the LDO voltage regulator 1.

Figure 6:
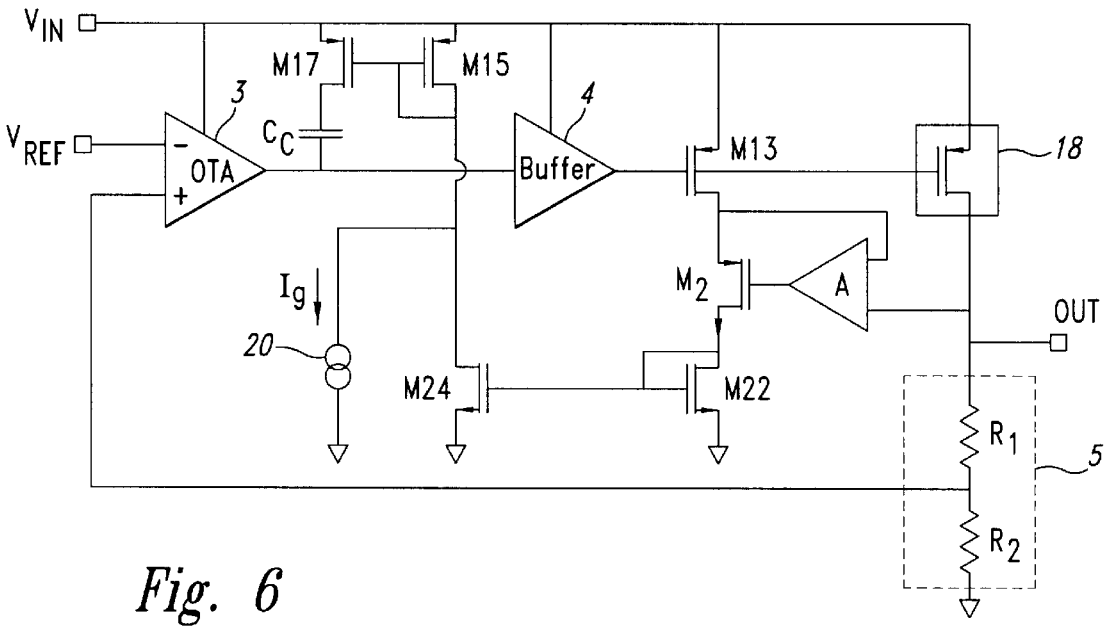
FIG. 6 is a schematic diagram showing the structure of a LDO linear voltage regulator according to another embodiment of the invention.

FIG. 6 shows a schematic view of a circuit solution 10 that includes a sensing transistor, according to an embodiment of the present invention. The circuit 10 provides a compensation network with a moving zero.

The current flowing through a sense transistor Msense 13 is mirrored and used to bias a transistor M15, thereby forcing a voltage drop Vgs−Vt on the transistor M17.

A current Ig coming from a current generator 20 allows the determination of the overdrive voltage value in low load conditions. This means that even the value of the resistance Rc is determined by this current Ig.

No current flows through the transistor M17, under biasing conditions, and its voltage drop Vds is null. Moreover, the resistance Rc is reduced in relation to the square root of the load current according to the following relation:

$$Rc=1/\mu_p Cox(W/L)_{M17}*[(n'*Iload*\gamma+Ig)/\mu_p Cox*½*(W/L)_{M15}]^{1/2}=1/([2*\mu_p Cox*r]^{1/2}*[n'*Iload*\gamma+Ig]^{½})$$

Where $\epsilon$is the mirroring ratio between transistors M22 and M24;

$\mu$ is carrier mobility n' is the ratio Is/Iload; and r is $(W_{17}/L_{17})^2$ / $W_{15}/L_{15}$.

The sense transistor 13 may be used to improve the behavior of the voltage regulator 10 both for small and for large signals speeding up the response during transients but keeping a high efficiency.

The efficiency of a voltage regulator is defined as the ratio between the power supplied at the output and the power adsorbed at the input as:

Pout/Pin=Vload*Iload/Vin(Ibias+Iload)=V*I

Where V=Vout/Vin is the voltage efficiency

And I=Iload/(Ibias+Iload) is the current efficiency

The biasing current Ibias is minor in stand-by conditions and a high current efficiency is obtained by the regulator 10. Moreover, the limits on the current value are less restrictive when the load current is higher.

The current of the sense transistor 13 is mirrored to produce a current generator proportional to the load, thereby avoiding a dynamic biasing. (FIG. 7) However, there is a positive reaction linked to the current flowing inside the power PMOS pass-transistor 18 during the transient. When this current rises, the amplifier biasing also rises. This fact does not allow an increase in the bias current in the gain stage 3 since, in that case, the system would become unstable.

Figure 8:
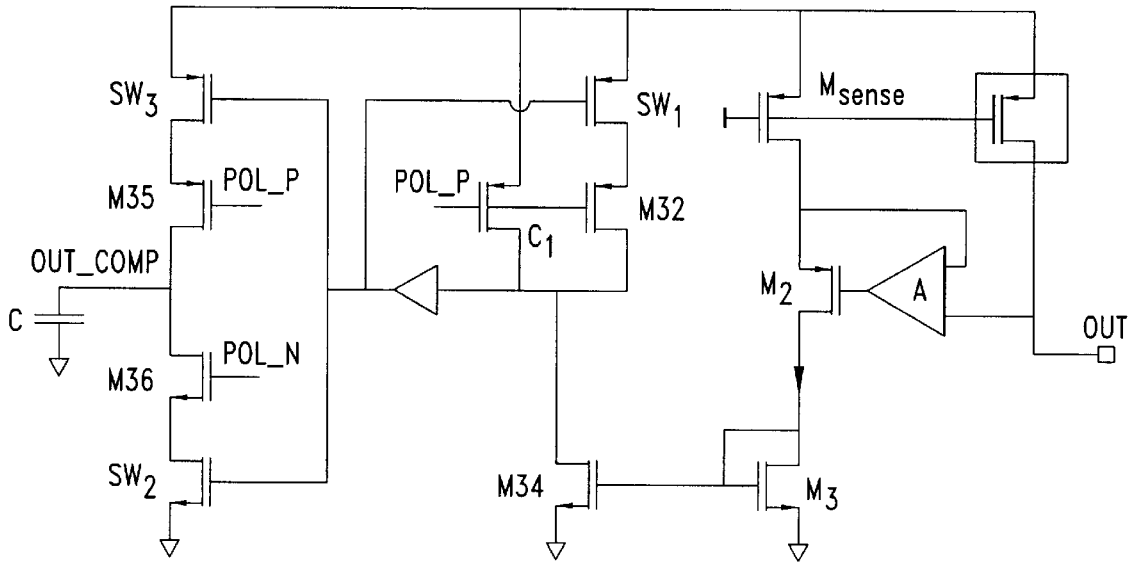
FIG. 8 is a schematic diagram showing a hysteresys comparator that can be integrated with a LDO linear voltage regulator according to an embodiment of the invention.

The biasing may be modified using an hysteresis comparator 30, as shown in FIG. 8. The current generators formed by the transistors 32, 34 define the threshold of the comparator 30. When the current reaches and overcomes the limit value set by a current generator, the comparator switches and the output falls to ground.

Figure 9:
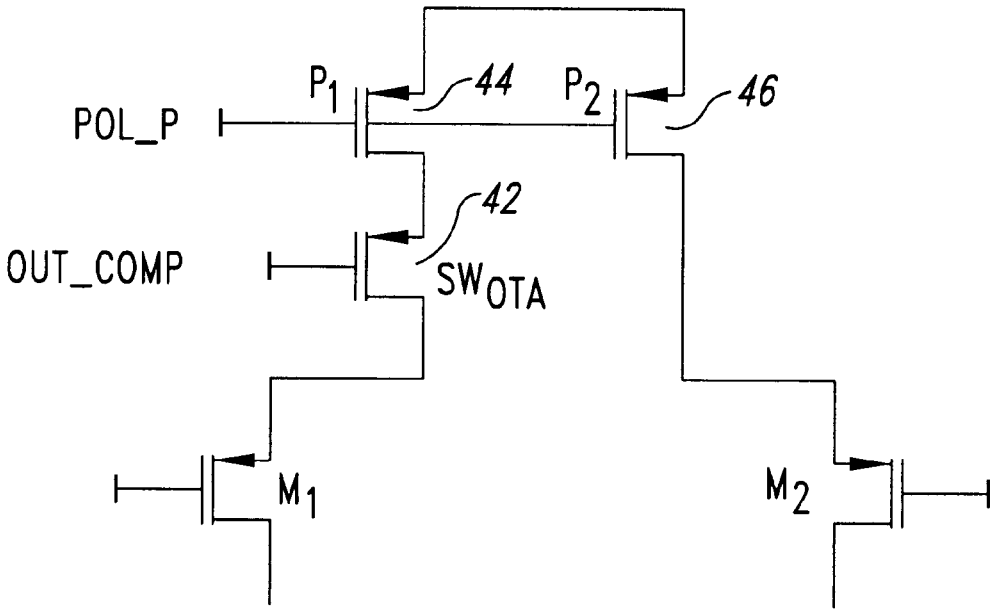
FIG. 9 is a schematic diagram showing a switch structure that can be integrated with a LDO linear voltage regulator according to an embodiment of the invention.

As shown in FIG. 9, The comparator 30 can drive a P-channel switch 42 serially connected to the output line of the OTA 3. The P-channel switch 42 is parallel connected to the other transistor 46, used for fixing the current for the low load conditions.

Figure 7:
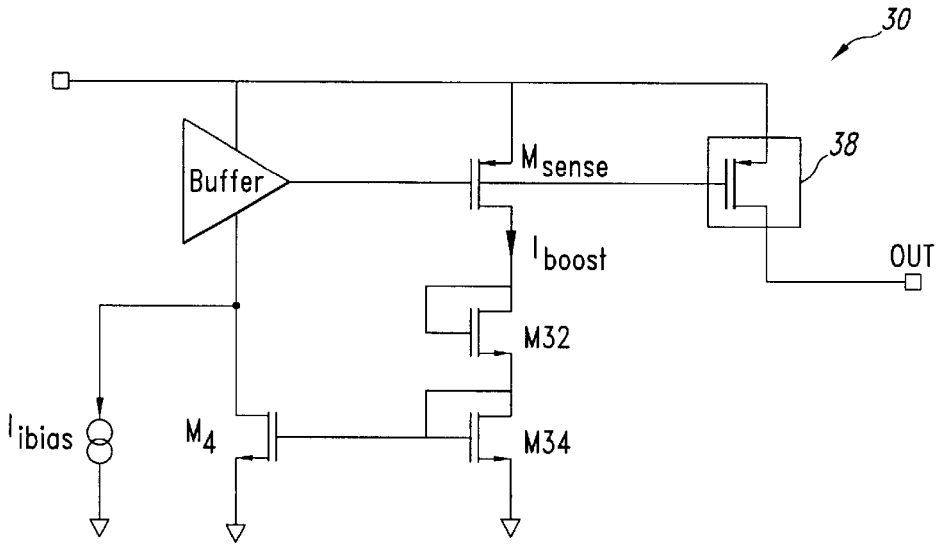
FIG. 7 is a schematic diagram showing the dynamic biasing.

The generator is connected in parallel to implement the hysteresis comparator 30, thus avoiding dangerous intervention due to disturbs or excess current flowing in a power transistor 38, as shown in FIG. 7.

The hysteresis comparator 30 output is connected to a ramp generator whose time constant is determined by a ratio I/C, where the current I is given by the two generators 35, 36 and C is the output capacitor. This allows a slow turn on of the switch 42, thereby increasing the current of the OTA 3 with a certain delay. This avoids instabilities of the LDO voltage regulator.

The circuits according to embodiments of the invention are particularly useful to speed up transient from low to high load of the LDO voltage regulator.

The LDO voltage regulator built according to these embodiments provides a regulation having high static and dynamic characteristics, and a high current efficiency in all load conditions.

The compensation network that introduces a zero in the loop gain of the LDO voltage regulator stabilizes the regulator at a frequency that is proportional to the load current.

Referring back to FIG. 6, In one embodiment of the invention, the power PMOS transistor 18 can be a structure formed by an array of hundreds of elementary transistors connected in parallel. Each elementary transistor brings a fraction of the whole current flowing through the power MOS transistor 18.

By using a portion of the elementary transistors array, it is also possible to form the sense transistor 13, having a flowing current Is determined by a ratio n between the number of elementary transistors forming the sense transistor and the total number of elementary transistors forming the power MOS:

n=Number of "sense" transistors/Total number of transistors

Is/Ip

This ratio n is substantially a mirroring ratio. Since n may be very small, this structure can easily detect the load current without the problem of the power dissipation.

The value n depends also by the different voltage drops Vds (drain-source) on the elementary transistors. Moreover, there is a difference between an ideal ratio n and the real value of n. This difference is mainly due to a low Early voltage of the power PMOS because of its short channel length.

To reduce the above difference it would be advisable to force at the same potential all the drain voltages on the elementary transistors forming the power PMOS transistor 18.

Changes can be made to the invention in light of the above detailed description. In general, in the following claims, the terms used should not be construed to limit the invention to the specific embodiments disclosed in the specification and the claims, but should be construed to include all methods and devices that are in accordance with the claims. Accordingly, the invention is not limited by the disclosure, but instead its scope is to be determined by the following claims.

What is claimed is:

1. A low drop out linear voltage regulator with frequency compensation comprising:

an input stage including an error amplifier having an output terminal;

an output stage including an output transistor having a conduction terminal connected to an output terminal of the voltage regulator, and having a control terminal coupled to the output terminal of the error amplifier;

a variable compensation network connected to the error amplifier, wherein the variable compensation network includes an RC circuit comprising a resistive transistor and a capacitance; and a sense transistor coupled to the control terminal of the output transistor and having a conduction terminal coupled to a control terminal of the resistive transistor.

2. The low drop out linear voltage regulator of claim 1 wherein the error amplifier comprises a differential stage and a buffer stage, and wherein the variable compensation network is coupled to an output of the differential stage.

3. The voltage regulator of claim 1 wherein the variable compensation network varies an effect on the voltage regulator responsive to a signal generated at the output terminal of the voltage regulator.

4. The voltage regulator of claim 3 wherein the effect on the voltage regulator is shifting a zero.

5. The voltage regulator of claim 1 further comprising a voltage divider connected between the output terminal of the voltage regulator and an input of the error amplifier, the voltage divider coupled in a feedback loop to the input of the error amplifier.

6. The voltage regulator of claim 1 wherein the output transistor is a power transistor.

7. A method of circuit operation in a low drop out voltage regulator comprising:

accepting a reference voltage at an input stage having an error amplifier and a buffer stage;

controlling a power transistor by a signal generated at an output of the buffer stage to produce an output signal of the voltage regulator at an output terminal; and varying a zero of the voltage regulator based on a load current value of the output signal generated at the output terminal of the voltage regulator, wherein varying a zero comprises changing a resistance value of an RC circuit by changing a gate voltage of a resistive transistor, wherein changing a gate voltage of a resistive transistor comprises:

sensing a signal at the output of the buffer stage by a sensing transistor; and modulating a gate voltage signal coupled to a gate terminal of the resistive transistor based on the signal sensed by the sensing transistor.

8. A method of circuit operation in a low drop out voltage regulator comprising:

accepting a reference voltage at an input stage having an error amplifier and a buffer stage;

controlling a power transistor by a signal generated at an output of the buffer stage to produce an output signal of the voltage regulator at an output terminal; and dynamically moving a zero of the voltage regulator to a higher frequency as the load current of the output signal generated at the output terminal of the voltage regulator raises, wherein dynamically moving a zero comprises changing a resistance value of an RC circuit by changing a gate voltage of a resistive transistor, wherein changing a gate voltage of a resistive transistor comprises:

sensing a signal at the output of the buffer stage by a sensing transistor; and modulating a gate voltage signal coupled to a gate terminal of the resistive transistor based on the signal sensed by the sensing transistor.

* * * * *